United States Patent [19]

Sichak

[11] 4,192,086

[45] Mar. 11, 1980

[54] DEODORIZING INSOLE

[75] Inventor: Stephen Sichak, Dolton, Ill.

[73] Assignee: Scholl, Inc., Chicago, Ill.

[21] Appl. No.: 947,156

[22] Filed: Sep. 29, 1978

[51] Int. Cl.[2] ..... A43B 13/38; A43B 7/06

[52] U.S. Cl. ..... 36/44; 36/3 B; 428/244; 428/300

[58] Field of Search ..... 36/44, 43, 3 B; 428/300, 244, 283; 28/115

[56] References Cited

U.S. PATENT DOCUMENTS

| | | | |
|---|---|---|---|
| 1,926,283 | 9/1933 | Herbert | 36/44 |
| 2,061,911 | 11/1936 | Leindorf | 36/43 |
| 2,451,939 | 10/1948 | Dorgin | 36/44 |
| 3,022,813 | 2/1962 | Glover | 28/115 |
| 3,842,519 | 10/1974 | Lapidus | 36/44 |
| 3,852,897 | 12/1974 | Bridge et al. | 36/44 |
| 4,055,699 | 10/1977 | Hsiung | 36/44 |
| 4,062,131 | 12/1977 | Hsiung | 36/44 |
| 4,099,342 | 7/1978 | Singh | 36/44 |

FOREIGN PATENT DOCUMENTS

| | | | |
|---|---|---|---|
| 2310100 | 12/1976 | France | 36/3 B |
| 376636 | 5/1964 | Switzerland | 428/300 |
| 220865 | 8/1924 | United Kingdom | 36/44 |
| 728075 | 4/1955 | United Kingdom | 36/3 B |
| 794938 | 5/1958 | United Kingdom | 36/3 B |
| 1088593 | 10/1967 | United Kingdom | 428/300 |
| 1253028 | 11/1971 | United Kingdom | 428/244 |

*Primary Examiner*—James Kee Chi

*Attorney, Agent, or Firm*—Hill, Van Santen, Steadman, Chiara & Simpson

[57] ABSTRACT

A laminar insole for footwear has a top, porous, non-woven, non-absorbent layer or mat of plastics material fibers, an intermediate moisture absorbing paper or other non-woven layer impregnated with deodorizing material, such as activated charcoal, coated on the paper fibers, and a bottom open-cell plastics foam cushion layer cured in-situ on the intermediate paper layer. The top and intermediate layers are stitch bonded together by pushing fibers from the top layer into and through the intermediate layer which also form anchors for the bottom layer. No added adhesives are needed to unite the layers. A myriad of holes are punched through all of the layers exposing the deodorizing chemical in the paper layer to air that is pumped through the insole as the foam layer is compressed and expanded upon application and release of foot load on the insole as in walking. The non-absorbent fibers of the top layer present a smooth and slippery top surface even under excessive moisture conditions while the bottom surface of the foam layer grips the shoe liner. The strength of the paper layer may be increased by coating the foam layer receiving face with a sizing material which is perforated during the stitch bonding operation.

14 Claims, 7 Drawing Figures

Fig. 1
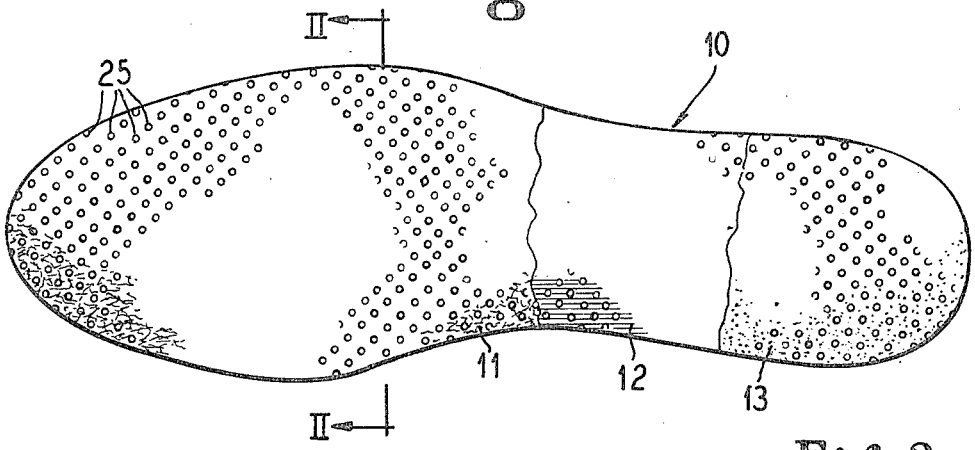
Fig. 2
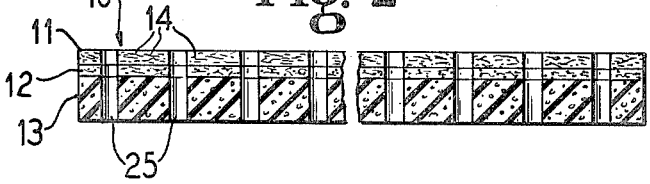
Fig. 3
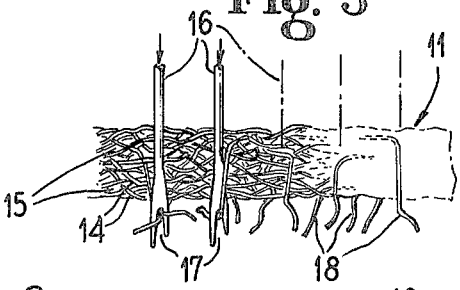
Fig. 4
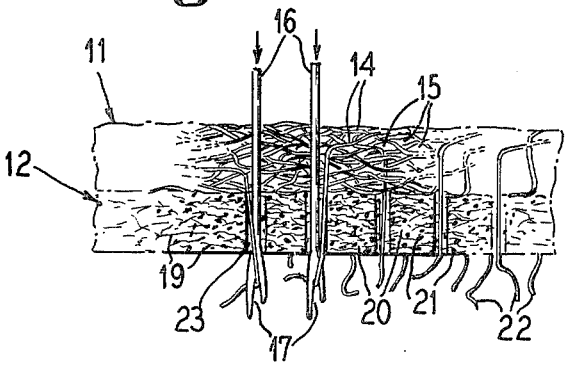
Fig. 6
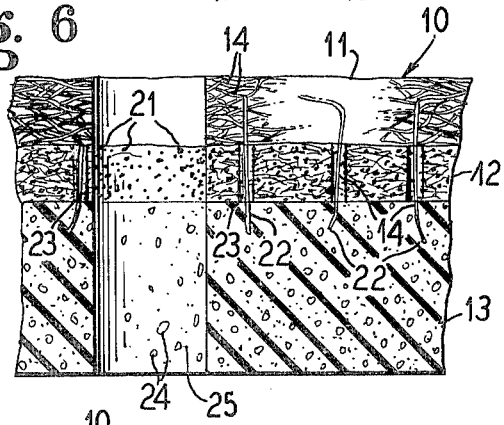
Fig. 7
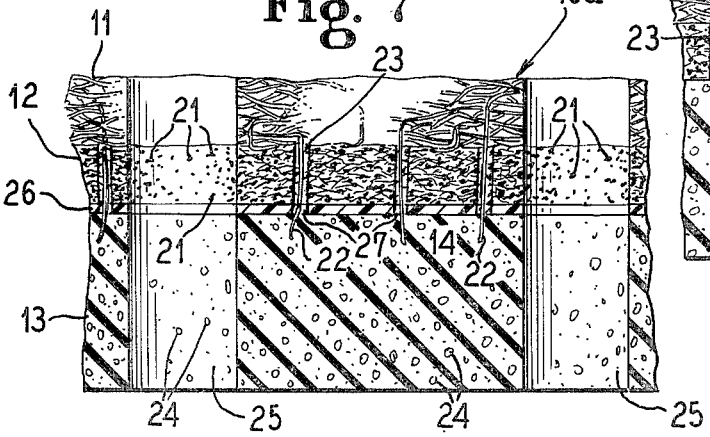
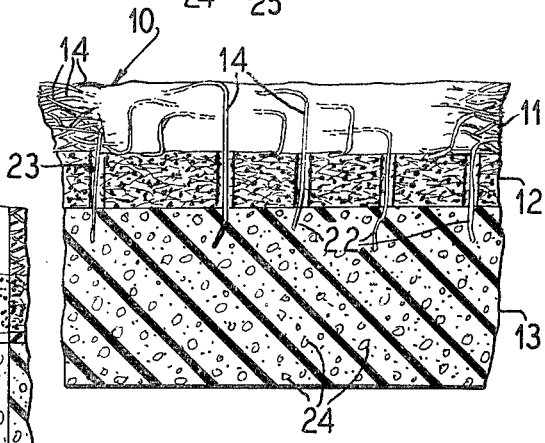
Fig. 5

DEODORIZING INSOLE

BACKGROUND OF THE INVENTION

Field of the Invention

This invention relates to the art of insoles or insocks for footwear which will absorb moisture and foot odors. Specifically the invention deals with a laminar insole having an intermediate moisture and odor absorbing intermediate paper layer stitch bonded to a porous non-absorbing fiber top layer and bonded to an open-celled resilient foam layer of plastics material. The stitch bonding pushes fibers from the top layer into and through the paper layer to strengthen this layer against tearing or separation.

Holes through all layers increase the porosity of the insole and expose the odor absorbing material in the paper layer to air which is pumped through the insole as it is alternately flattened and expanded upon application and release of foot load.

SUMMARY OF THE INVENTION

According to this invention there is provided a multilayer laminated insole or insock shaped to fit the footwear and having a bottom surface which will frictionally grip the footwear and a top slippery surface which will facilitate the insertion of a foot into the footwear. The insole provides a comfortable foot cushion, absorbs moisture from perspiration of the foot, and contains a chemical which will absorb and destroy foot odors. The layers of the laminar insole include a top porous non-woven, non-absorptive layer or mat composed of plastics material fibers such as polypropylene, rayon, and the like, an intermediate moisture absorbing paper layer composed of cellulose fibers coated and impregnated with an odor absorbing chemical such as activated charcoal, silica gel and the like, and an open-celled resilient plastics material layer, such as foam latex, formed in-situ on the intermediate layer. Fibers from the top layer are pushed into and through the intermediate layer to stitch bond the two layers together while increasing the strength of the paper layer against tearing. Since the bottom layer is cured in-situ on the intermediate layer it will adhere to the paper fibers and top layer fibers pushed through the paper, without a necessity for added binders.

The insole is pliable, has a top surface which is soft, smooth and slippery, and a bottom surface which grips the shoe. The pliable insole cushions the foot and readily conforms with the foot contour.

The odor absorbing chemical such as activated charcoal, silica gel, or the like can be impregnated into the paper as it is formed on a paper making machine. The moisture absorbing cellulose fibers of the paper are thus impregnated and coated with the chemical and the particles of the chemical surround and cover the fibers in full open communication with the interstices of the paper.

The strength of the paper layer may be increased by coating its foam layer receiving face with conventional paper sizing materials such as clays, plastic sizing coatings or the like. The coated face is perforated by the stitch bonding needles so that air flow through the paper remains unimpeded.

The foam layer is preferably composed of latex or polyurethane and is substantially thicker than the top and intermediate layers having an uncompressed thickness of at least about one-eighth of an inch with acceptable thickness dimensions varying widely up to one-fourth inch. The bottom surface of the foam layer may be smooth but has a relatively high coefficient of friction to grip the shoe in which the insole is inserted.

The intermediate paper layer and the top non-woven fiber layer may vary in thicknesses from one-sixteenth to three-sixteenths inches.

Generally the foam layer has a greater thickness than the combined thicknesses of the top non-woven layer and the intermediate paper layer. Also, generally, the top non-woven layer is thinner than the intermediate paper layer and may be as thin as one-thirty-second of an inch.

A myriad of holes are punched through all of the layers of the insole and are normal to the flat plane of the insole. These holes are preferably arranged in transverse rows with the holes of adjacent rows in off-set relation. The holes are large enough so that they will not close when the foam layer is compressed under foot load and provide passageways through the insole which are surrounded by the odor absorbing chemical materials in the paper layer so that as air passes through the insole it must pass in intimate contact with the chemicals. In addition the air flows through the interstices of the paper in intimate contact with the chemical coated on the fibers.

The diameters of the holes are preferably about 0.5 inches and are preferably spaced about 0.3 inches.

It is desirable to have a maximum amount of odor absorbing chemical retained in the paper layer and particles of the chemical are deposited from a slurry of the chemical onto the paper fibers as they are being formed into a web on a paper making machine or the chemical can be added to the paper stock fed to the paper making machine. For example it is desired to have powdered activated charcoal deposited on all the paper fibers, penetrated into the fibers, and even retained in the interstices of the paper. Loading of the paper with 60% or more by weight of charcoal is feasible. A range of 30 to 60% is practical.

It is then an object of this invention to provide a laminar insole or insock for footwear, which will absorb moisture and odors, composed of a porous non-moisture absorbing fibrous top layer, an intermediate paper layer loaded with odor absorbing particulate chemical material, and an open-cell resilient foam bottom layer with fibers from the top layer pushed through the intermediate layer and anchored in the foam layer to unite the layers without barrier forming binders.

A further object of the invention is to provide a multilayer cushion insole for footwear with a non-woven, non-absorbent porous top mat, an intermediate paper sheet and an open-cell resilient foam base having fibers from the top mat pushed into the intermediate paper sheet to unite the mat and sheet in tight coherent adjacent relation while strengthening the paper sheet.

Another object is to provide an insole having a plurality of layers stitch bonded together.

A specific object of the invention is to provide an insole for footwear having a top layer composed of non-woven, non-absorptive plastics material fibers, an intermediate paper layer impregnated with particulate activated charcoal, a bottom layer of open-celled plastics foam, and a myriad of holes punched through all of the layers exposing the activated charcoal to air flowing through the holes.

A general object of the invention is to provide an insole or insock for footwear having a top non-absorbent porous layer, a bottom cushion layer, and an intermediate porous layer impregnated with an odor absorbing chemical.

Other and further objects of the invention will become apparent to those skilled in this art from the following detailed description of the annexed sheet of drawings in which:

FIG. 1 is a top plan view, with parts broken away to show underlying layers of an insole according to this invention.

FIG. 2 is a transverse cross-sectional view taken along the line II—II of FIG. 1.

FIG. 3 is an enlarged fragmentary cross-sectional view, with parts in elevation, illustrating a preliminary step for strengthening the non-woven top layer of the insole.

FIG. 4 is a view similar to FIG. 5 but illustrating the further step of stitch bonding the non-woven top layer to the intermediate layer of the insole.

FIG. 5 is a greatly enlarged fragmentary vertical section through the insole illustrating the anchoring of the bottom foam layer to fibers from the top layer.

FIG. 6 is a view similar to FIG. 5 but showing the exposure of particles of odor absorbing chemical around the peripheries of the holes through the insole.

FIG. 7 is a view similar to FIG. 6 but showing a coating on the intermediate paper layer perforated by the stitch bonding needles.

AS SHOWN ON THE DRAWINGS

The reference numeral 10 of FIGS. 1, 2, 5 and 6 illustrates a laminar insole for footwear according to this invention composed of a top layer 11, an intermediate layer 12, and a bottom layer 13.

The top layer 11 is a porous non-woven mat of non-moisture absorbing plastics material fibers 14. These fibers are loosely felted together and have large open spaces or interstices 15 therebetween.

As shown in FIG. 3 the mat 11 can be strengthened into a more cohesive layer without closing the interstices 15 by pushing stitch bonding needles 16 transversely through the mat. These needles have forked ends 17 adapted to engage fibers 15 and push the same through the mat as at 18. These pushed fibers are freed from the forked ends 17 of the needles as the needles are withdrawn.

The fibers 15 are preferably formed from plastics materials which do not absorb moisture such as, for example, polyethylene, rayon, polyester, nylon, polypropylene and the like.

The layer 12 is formed of a non-woven material capable of being impregnated and absorbing moisture.

The layer 12 is a sheet of paper formed on a paper making machine from moisture absorbing cellulose fibers 19 which are interwoven but have interstices 20 therebetween providing porosity to the sheet. These fibers 19 are impregnated and coated with particles 21 of an odor absorbing chemical such as activated charcoal, silica gel or the like. The chemical impregnated paper 12 can be formed on a paper making machine with the chemical applied during formation or admixed with the paper stock.

As shown in FIG. 4 the stitch bonding needles 16 can have their forked ends 17 extended through the paper layer 12 to perforate the layer and also pull fibers 14 from the top layer 11 through the paper forming a pile 22 composed of the pulled through fibers projecting beyond the paper. As shown the needles 16 will form holes 23 through the paper layer 12 increasing the porosity of the layer.

The fibers 14 which are pushed into and through the paper layer 12 will stitch bond the non-woven mat 11 to the paper 12 forming a substantially inseparable multilayer laminate. At the same time the pushed through fibers will strengthen the paper 12 against tearing especially when the cellulose fibers 19 of the paper are wet.

As shown in FIG. 5 the foam layer 13 receives the pile extensions 22 of the fibers 14. The layer 13 is formed in-situ on the paper 12 by doctoring a slurry of latex or the like foam mix onto the paper to a desired thickness and then heat curing the doctored layer causing it to foam and form open cells 24 throughout its mass. The pile extensions 22 of the fibers 14 are embedded in the foam layer forming anchors which effectively bond the foam layer 13 to the paper 12 without the aid of adhesives.

A conventional elastomeric plastic foam mix, such as rubber latex, polyurethane, and the like is useful to form the layer 13. Formula F 7653 furnished by Coated Fabrics, Inc. of Dolton, Ga. and "Foamcote" furnished by Crown Products Corporation of St. Louis, Mo. are satisfactory formulations to provide the open-celled resilient cushion foam layer 13.

The three layer laminate composed of the stitch bonded non-woven non-absorbing fibrous top layer and intermediate paper layer and the bottom foam layer is then punched to form a myriad of holes 25 therethrough extending normal to the flat plane of the insole. These holes, as shown in FIG. 6 cut through the open pores 24 of the foam layer 13 and through the paper layer 12 to expose the deodorizing chemical particles 21 around the peripheries of the holes. The fibers 14 of the top layer 11 are also cut cleanly so that the holes 25 are unimpeded through the entire thickness of the insole.

As foot load is applied to and released from the insole 10, the resilient open-celled foam cushion layer 13 is alternately flattened and expanded pumping air from and into the pores 24 through the holes 25. Air flow is thus established in footwear containing the insole to draw moisture from foot perspiration into the moisture absorbing paper layer 12 where the chemical 21 will absorb and destroy odors in the moisture laden air. Air will also flow through the spaces 15 between the fibers 14 of the non-woven top layer 11 and through the interstices 20 between the fibers 19 of the paper layer 12 as well as through the perforations 23 formed by the needles 16. The insole thus has an open porosity unimpeded by bonding agents at the interfaces of the laminate and remains soft and pliable throughout its use.

In the modification shown in FIG. 7 the insole 10A is composed of the same layers 11,12 and 13 as the insole 10 and has the same holes 25 therethrough. However the paper layer 12 has a coating 26 on its bottom face which is bonded to the foam layer 13. This coating 26 may be any conventional paper strengthening material such as a plastics sizing composition. As an example an acrylic emulsion may be used. The coating is punctured by the needles 16 and of course by the holes 25 so as not to appreciably decrease the porosity of the paper layer 12. The pile extensions 22 of the fibers extend through the coating into the foam layer as in the insole 10.

From the above descriptions it will therefore be understood that the insoles of this invention are composed of at least three layers including a non-moisture absorbing soft fiber layer, an intermediate moisture absorbing paper layer impregnated with odor absorbing chemical material, and a bottom open-celled resilient foam layer. The top and intermediate layers are stitch bonded by fibers displaced from the top layer into and through the paper layer. The stitch bonding integrally unites the two layers. The foam layer is formed in-situ on the intermediate layer and fibers pushed through the paper layer from the top layer form a pile which firmly anchors the foam layer to the paper layer. The insole is soft and pliable, provides a cushion, and effects a circulation of air through the footwear and around the foot to draw perspiration and foot odors into the paper layer where they are absorbed and chemically treated.

No binders are needed to unite the layers and air flow barriers created by such binders are avoided.

I claim as my invention:

1. An insole which comprises a porous top layer of non-woven non-absorbing plastics material fibers, an intermediate layer of moisture absorbing non-woven material impregnated with an odor absorbing chemical, and a bottom open-cell resilient plastics material foam layer, said top layer having fibers thereof penetrating the paper stitch bonding together the top and intermediate layers and having ends surrounded by and integrally bonded in the foam layer, and said insole having a myriad of holes therethrough exposing the chemical of the intermediate layer to air flow through the insole as the foam layer is flattened and expanded by application and release of foot load on the insole.

2. A multi-layer integrally laminated insole for footwear which comprises a soft porous mat of non-moisture absorbing fibers having a smooth slippery top surface, an intermediate paper sheet of moisture absorbing fibers, a particulate odor absorbing chemical on the fibers of said paper sheet, an open-cell resilient foam plastics material underlying said paper sheet and having a bottom surface with a high coefficient of friction for gripping the liner of a shoe in which the insole is inserted, and non-absorbing fibers of said porous mat stitch bonded between the moisture absorbing fibers of the paper sheet extending into the foam plastics material layer and integrally bonded with the plastics material.

3. A multi-layer laminated insole for footwear which comprises a loosely matted top layer of plastics material fibers impervious to moisture, an intermediate moisture absorbing fiber layer impregnated with an odor absorbing chemical, a bottom layer of resilient open-cell plastics foam cured in situ on the intermediate layer, and fibers displaced from said top layer extending through said intermediate layer into said bottom layer and cured therein in bonded relation with the plastics foam to integrate all of the layers without impeding air flow through the insole.

4. The insole of claim 1 wherein said intermediate layer is paper with the top layer fibers penetrating the paper extending beyond the paper forming a pile and the bottom foam layer is formed around the pile with extended ends of said fibers bonded to the plastics material.

5. The insole of claim 1 wherein said top layer has fibers displaced through the layer to form a mat.

6. The insole of claim 1 wherein the non-woven layer is paper, the paper is composed of cellulose fibers coated with the odor absorbing chemical.

7. The insole of claim 1 wherein the bottom layer is formed in-situ on the intermediate layer.

8. The insole of claim 1 wherein the holes remain open when the foam layer is flattened.

9. The insole of claim 6 wherein the chemical is particulate activated charcoal in the amount of 30 to 60% by weight of the paper.

10. The insole of claim 2 wherein the mat is composed of synthetic plastics material fibers.

11. The insole of claim 2 including holes punched through all of the layers exposing the chemical.

12. The insole of claim 3 including a coating on the bottom layer receiving face of the intermediate layer.

13. The insole of claim 12 wherein the intermediate layer is a paper sheet, the coating strengthens the paper sheet, and perforations extend through the coating.

14. The insole of claim 13 wherein the perforations have therein fibers from the top layer.

* * * * *